US007971356B2

(12) United States Patent
Orobengoa Ortubay et al.

(10) Patent No.: US 7,971,356 B2
(45) Date of Patent: Jul. 5, 2011

(54) METHOD FOR CONTOUR GRINDING WIDE BLADES AT HIGH SPEED

(75) Inventors: Xabier Orobengoa Ortubay, Elgoibar (ES); Harvinder Sigh Chana, Elgoibar (ES)

(73) Assignee: Danobat, S.Coop., Elgoibar (Guipuzcoa) (ES)

( * ) Notice: Subject to any disclaimer, the term of this patent is extended or adjusted under 35 U.S.C. 154(b) by 1041 days.

(21) Appl. No.: 11/770,242

(22) Filed: Jun. 28, 2007

(65) Prior Publication Data

US 2008/0005904 A1 Jan. 10, 2008

(30) Foreign Application Priority Data

Jul. 4, 2006 (ES) ..... 200601797

(51) Int. Cl.

| | |
|---|---|
| ***B21K 25/00*** | (2006.01) |
| ***B23C 1/00*** | (2006.01) |
| ***B23C 3/12*** | (2006.01) |
| ***B24B 3/46*** | (2006.01) |
| ***B24B 7/00*** | (2006.01) |

(52) U.S. Cl. ..... 29/889.23; 29/56.5; 409/138; 409/140; 451/258; 451/260

(58) Field of Classification Search ..... 29/889.23, 29/56.3; 409/131, 138, 139, 140, 8, 9; 451/242, 451/246, 306, 258–260, 282, 28, 57, 214
See application file for complete search history.

(56) References Cited

U.S. PATENT DOCUMENTS

| | | | | |
|---|---|---|---|---|
| 5,704,826 | A * | 1/1998 | De Luis Vizcaino | 451/242 |
| 6,905,312 | B2 * | 6/2005 | Bourgy et al. | 416/234 |
| 7,303,461 | B1 * | 12/2007 | Campomanes et al. | 451/28 |
| 7,377,037 | B2 * | 5/2008 | Ouellette et al. | 29/889.23 |

FOREIGN PATENT DOCUMENTS

| | | | |
|---|---|---|---|
| GB | 2076323 | * | 3/1981 |
| GB | 2270485 | * | 9/1992 |

* cited by examiner

*Primary Examiner* — David P Bryant
*Assistant Examiner* — Alexander P Taousakis
(74) *Attorney, Agent, or Firm* — Lucas & Mercanti, LLP

(57) ABSTRACT

The invention relates to a method for contour grinding wide blades at high speed, according to which a wheel (1) is used the grinding contour of which has a width dimension that is less than the width of the tip of the blades to be ground, said contour being defined by a straight area followed by an arched area at one end, with the straight area of which a straight grinding is carried out to deburr the tip of the blades, whereas with the arched area the contour grinding is carried out by the interpolation of axes.

4 Claims, 8 Drawing Sheets

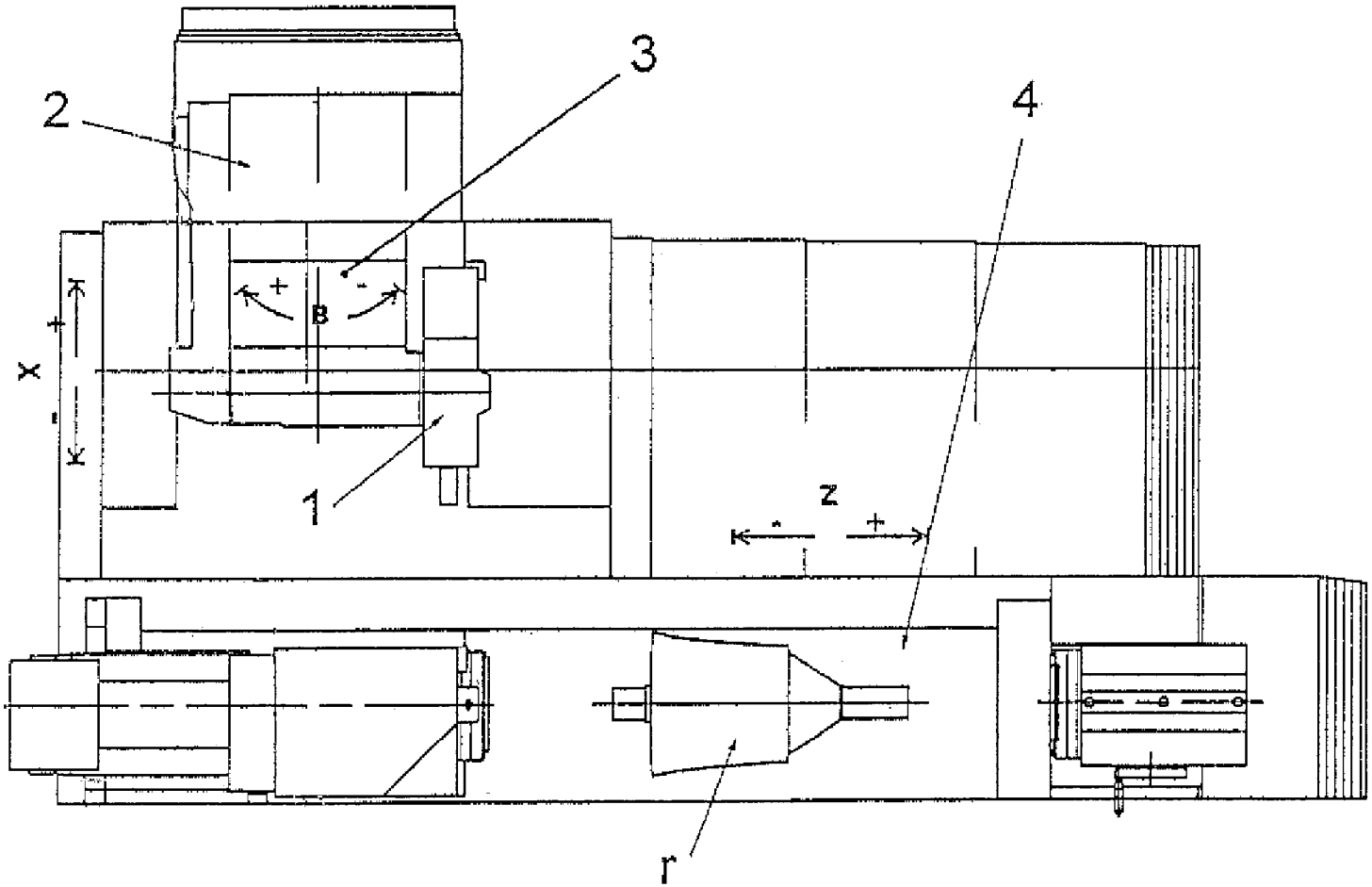
Fig. 3.1

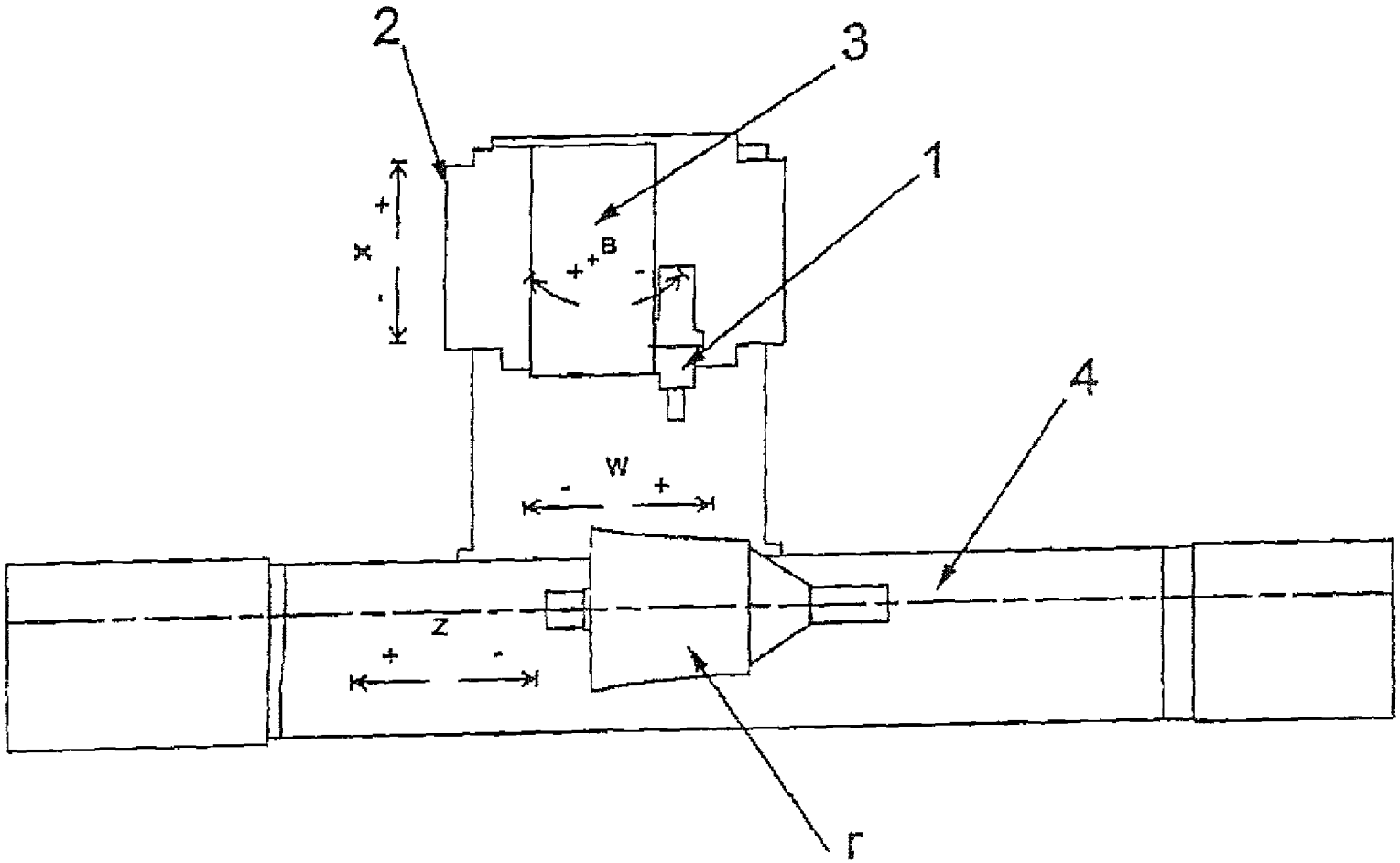
Fig. 3.2

METHOD FOR CONTOUR GRINDING WIDE BLADES AT HIGH SPEED

FIELD OF THE ART

The present invention relates to the contour grinding of rotor blades at high speed, proposing a method for contour grinding which is especially indicated for grinding rotor blades.

STATE OF THE ART

The contour grinding of the edges, called tips, of the rotor blades of a turbine or of a compressor is a process which has developed by means of using grinding machines incorporating at least one wheel, in which a work process defined by a first deburring phase is carried out, in which phase most of the material to be machined is pulled off, and a second final adjustment phase in which the finish grinding of said blades is carried out by contouring.

In the application of this type of rotors to the aerospace sector, the tip of the blades had a width dimension that was usually less than 73 mm and according to this, wheels the width dimension of which was greater than that of the blades were used; such that the deburring operation was carried out in a single in-depth grinding cycle.

The aerospace sector currently demands rotors in which some of their stages have wider blades, with a measurement that is equal to or greater than a width of 73 mm and hereinafter referred to as wide blades.

In this type of rotors with stages with wide blades, there is a serious problem if wheels the width of which is greater than 73 mm are used, because in the grinding of large rotors formed by multiple blade stages, the grinding wheel, due to its large width dimension, collides with the blades of stages adjacent to the stage which is being ground, this interference preventing the use of wheels the width dimension of which is identical or greater than the aforementioned measurement of 73 mm.

The Newall patent document GB 2 270 485 describes the application of a wheel for grinding blades, the profile of which can have a width dimension that is less than that of the tip of the blade.

To achieve this, a wheel is used the grinding contour of which is convex as seen in cross-section. This narrow wheel rotates about an axis parallel to that of the rotor. Furthermore, the wheel and the rotor move relative to one another in a direction "Z" parallel to the axis of the rotor and of the wheel; as well as in an axis "X" orthogonal to the previous one.

This narrow wheel with a convex profile can, working by the interpolation of axes "X" and "Z", grind the tip of the blades of a rotor, even when said tip has a non-straight profile, for example an angled or arched profile.

This Newall solution has a serious drawback when wide rotor blades are to be ground, because the deburring phase is also carried out by the interpolation of axes "X" and "Z" in a slow process, which worsens when a rotor with multiple blade stages is to be ground, giving rise to a very slow process.

OBJECT OF THE INVENTION

According to the solution now proposed, the method for contour grinding straight blades at high speed, uses, like in the Newall solution, a narrow wheel with a size that is smaller than the width of the blade vane, which allows grinding large rotors with several stages with at least some of its blades being wide, without interferences.

Instead of a narrow wheel with a convex profile, a narrow wheel is used the grinding contour of which has a profile defined by a straight area which at one of its ends is finished in an area defined by an arc-convex section.

The solution now proposed is shown in two variants which are graphically shown in FIGS. 3.1 and 3.2. The relative linear movement of the rotor with respect to the wheel, such movement being parallel to the rotation of the rotor, corresponds to the movement of axis "Z". The wheelhead can also move in the axis "X" orthogonal to axis "Z". The rotating plate of the wheelhead can rotate to offset the attack angle of the wheel with respect to the blade stage to be ground—Axis "B".

With the corresponding interpolation of the movements in axes "X", "Z" and "B", the wheel can grind blades the tip of which has a straight, angular or arched profile.

But furthermore and as an essential feature of the present invention, when large rotors with multiple stages are to be ground, the straight part of the wheel allows deburring the blade with this straight part of the wheel, the wheel acting on the blade on several occasions, in what it identified as "multi-plunging"/which allows a much faster deburring operation than with the solution proposed by Newall.

Furthermore, the grinding according to the method now proposed allows, using a wheel that is narrower than the tip of the blades, grinding multiple rotors without interferences, carrying out measurements in the blades of the rotor simultaneously to the grinding process itself, increasing the grinding precision, reducing the duration of each process cycle, etc.

DESCRIPTION OF THE DRAWINGS

FIGS. 3.1 and 3.2 show, according to respective schematic views, the degrees of freedom of the machine configurations in which the method object of the invention can be developed.

DETAILED DESCRIPTION OF THE INVENTION

The object of the present invention is related to high-speed contour grinders of the blades of a rotor, proposing a solution which thanks to its constructive and functional features is really advantageous for its application in grinding wide blades.

Figure 1:
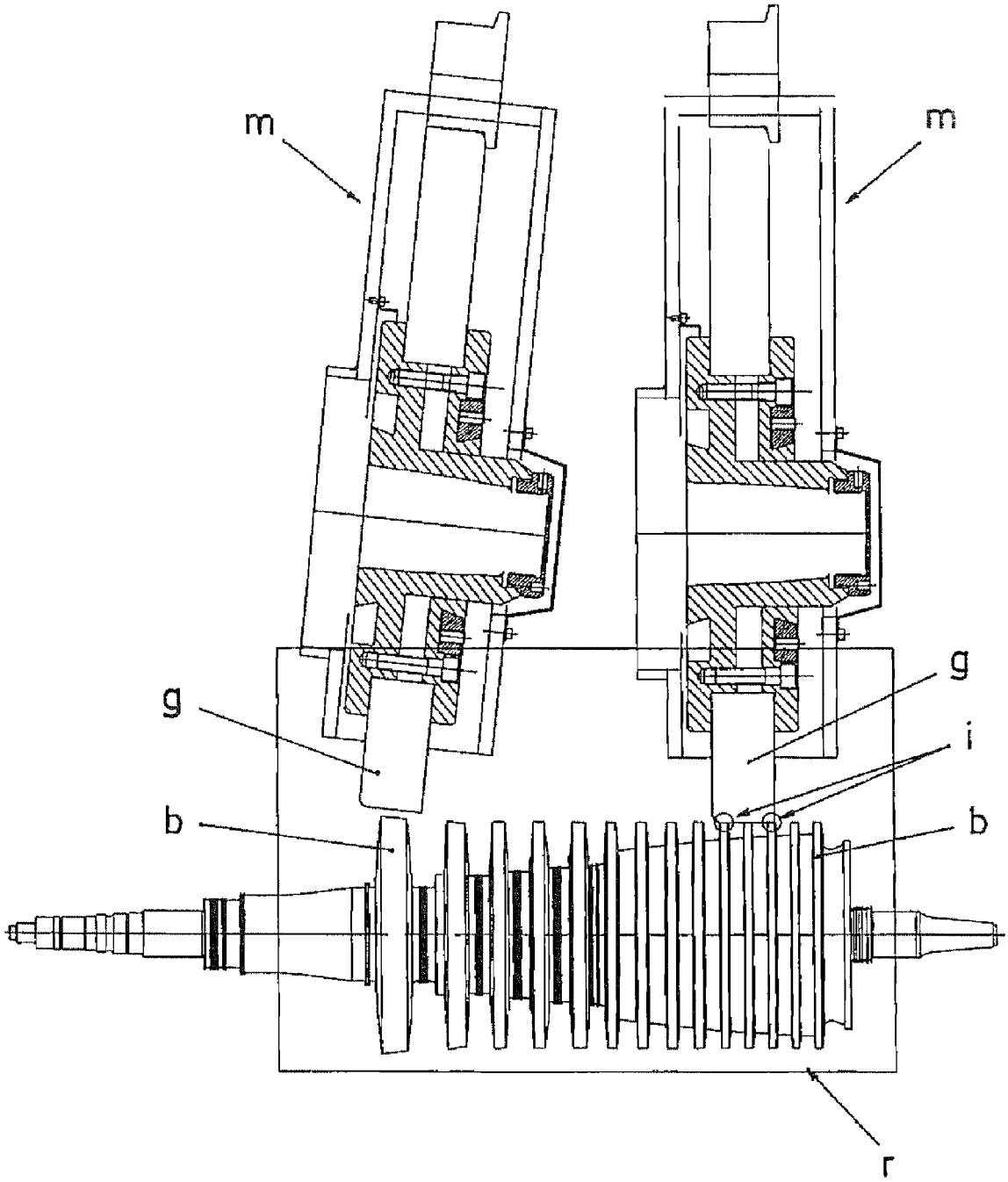
FIG. 1 shows an elevational view of a conventional solution for grinding a large rotor "r" with multiple blades to be able to observe the interferences "i".

Grinding machines "m", are known, the grinding wheels "g" of which have a width that is greater than the width measurement of the tips of the blades "b" of a rotor "r" of those used in the aerospace sector, as shown in FIG. 1.

With this solution, the method for grinding consisted of carrying out a first straight grinding operation for deburring the tip of the blade "b", which straight grinding is carried out with the straight area of the wheel "g" in a single action called "plunging" and later, carrying out a contour grinding with the arched area of one of the edges of the wheel "g".

The aerospace sector demands rotors "r" with wider blades "b"; such that the usual measurement, in which the tip of the blades "b" did not reach a width of 73 mm, has now been become large rotors with multiple stages, in which the blade "b" of at least some of the stages has a width dimension equal to or greater than 73 mm, hereinafter referred to as wide blades.

In this case, which is shown in FIG. 1, when rotors with multiple stages are ground, interferences such as those indicated by reference "i" in said FIG. 1 occur if wheels "g" with measurements greater than the measurement of the wide blades "b" are used. 1.

British patent document GB 2 270 485 describes a method for grinding wide blades by means of using a narrower wheel the grinding contour of which has an arc-convex profile. With this wheel and working by the interpolation of axes "X" and "Z", the tips of wide blades "b" could be ground even when said tip had a non-straight profile, for example, an angled or arched profile.

With this solution, since the profile of the wheel "g" is arc-convex, the deburring phase for deburring the tip of the blade "b" cannot be carried out by means of a straight grinding and must also be carried out by the interpolation of axes "X" and "Z", in a contour grinding process which is very slow, which worsens when a rotor with multiple stages is to be ground.

The object of the present invention consists of a method for contour grinding wide blades "b" of a rotor "r" at high speed.

Figure 2:
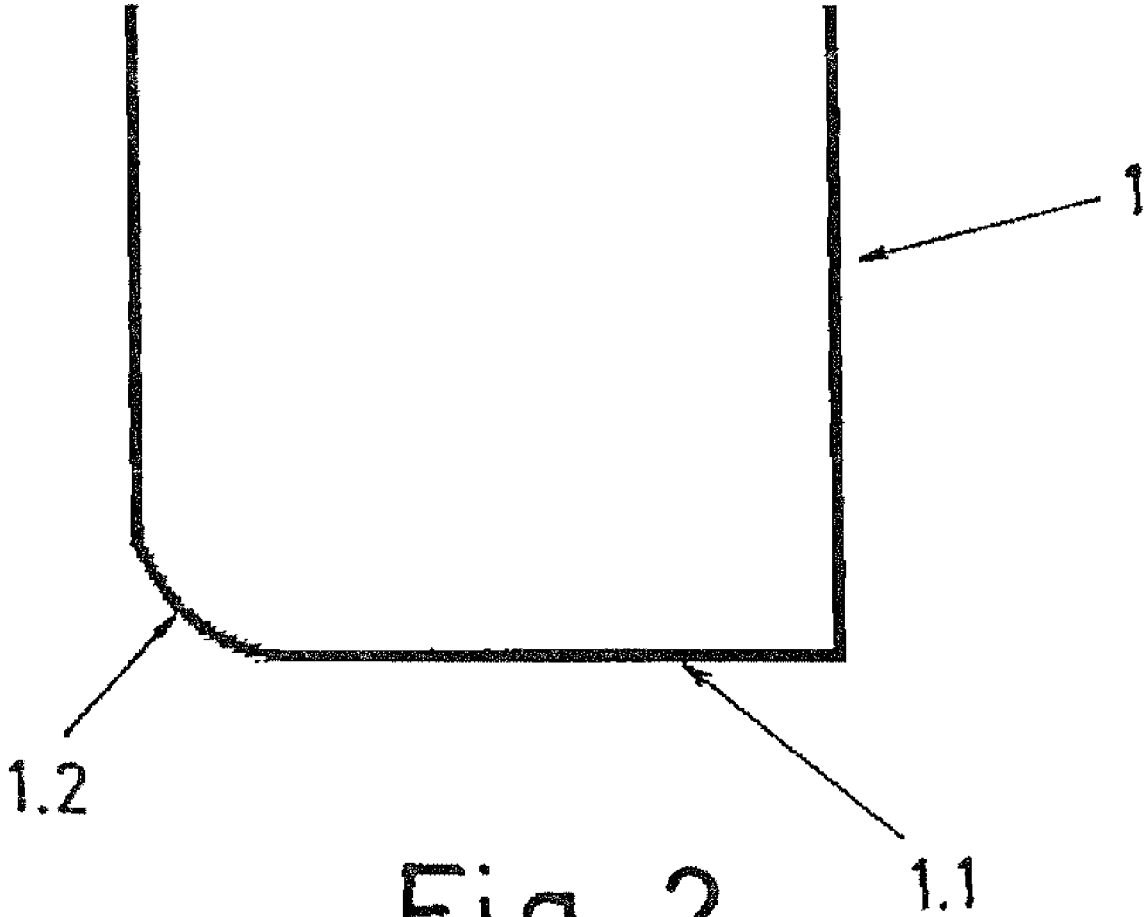
FIG. 2 shows a cross-sectional view of a grinding wheel 1, the grinding contour of which is formed by a straight area 1.1 and another arc-convex area 1.2.

The invention proposes the use of a wheel 1 which is narrower than the width dimension of the tip of the blades "b" of the rotor "r", i.e., less than 73 mm, and has a grinding contour defined by a profile divided into two areas 1.1 and 1.2, one of which 1.1 is straight and the other of which 1.2 is arc-convex, as can be seen in FIG. 2

The machine configurations proposed in FIGS. 3.1 and 3.2 allow developing the method object of the present invention, having movement in axes "X" and "Z", axis "X" being orthogonal to axis "Z".

The movement in axis "X" determines the penetrating movement of the wheelhead 3 with respect to the rotor "r" and the movement in axis "Z" defines its transverse movement in relation to the rotor "r".

Axis "Z" determines the transverse movement of the grinding machine, a movement parallel to the rotation of the working part, i.e., the rotor "r", this axis "Z" being parallel to the axis of rotation of the rotor "r".

The head 3 can further rotate according to the path indicated by the arc "B" in FIGS. 3.1 and 3.2, so as to position the angle of attack of the wheel 1 with respect to the blade "b" to be ground.

FIG. 3.1 shows a machine 2 with three degrees of freedom; whereas FIG. 3.2 corresponds to a machine 2 with four degrees of freedom, since it incorporates the possibility of movement of the head 3 according to axis "W". Axis "W" is parallel to axis "Z", but the movements in "W" can have a value different from the movements in "Z".

The interpolation of axes "X" and "Z" and the rotation in "B", together with the use of the different areas 1.1 and 1.2 of the wheel 1, according to the needs, allows grinding any type of blade "b", whether it has a straight, angular or arched (concave or convex) profile, and whether it has a width of less than 73 mm or it is a wide blade with a width equal to or greater than 73 mm.

Figure 4:
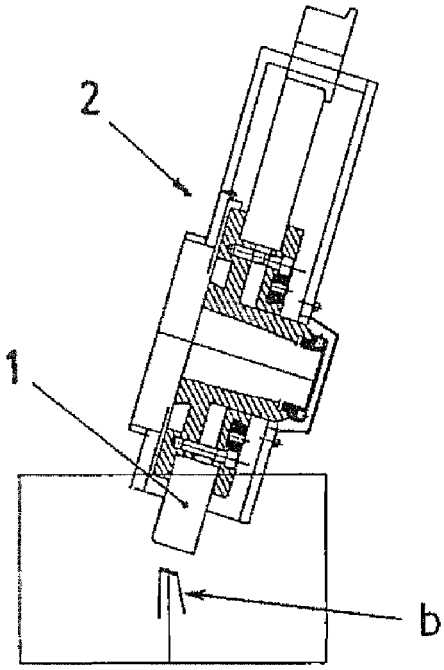
FIG. 4 shows an elevational view of an example of straight grinding, by means of the planar area 1.1 of a wheel 1, according to the method object of the invention, applicable in this case to a blade "b" with a width of less than 73 mm.
Figure 5:
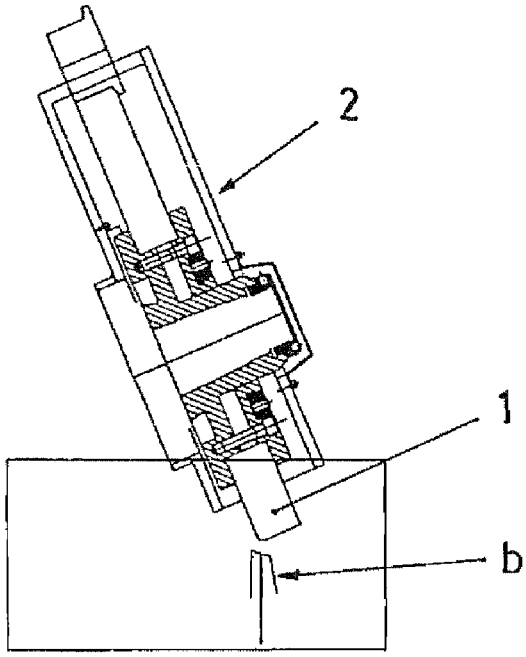
FIG. 5 shows an elevational view of an example of contour grinding the tip of blade "b" of FIG. 4 by means of the arc-convex area 1.2 of the wheel 1, according to the method object of the invention.

FIG. 4 shows the grinding of a tip of blade "b" with a width of less than 73 mm. The deburring is carried out by means of the planar area 1.1 of the grinding wheel 1. In this cycle, it is enough to move the wheel 1 closer by means of a movement in the axis "X" and rotate it by means of a rotation according to "B", such that the tip of the blade "b" is deburred by means of a single "plunging".

For the contour grinding of the tip of the blade "b" of FIG. 4, the grinding is carried out by means of the interpolation of axes "X", "Z", and the rotation of "B", such that the movement carried out by the wheel 1 is adjusted to the profile of the tip of the blade "b", i.e., carrying out a contour grinding, as shown in FIG. 3.

In other words, in this case, the planar area 1.1 of the wheel 1 is used for deburring the tip of a blade "b" in a single in-depth straight grinding cycle, in a single "plunging", whereas the arc-convex area 1.2 is used in the contour grinding of the tips of the blades "b" by means of the interpolation of the axes of the grinding machine 2, generating the relative movement of the wheel 1 with respect to the tip of the blade "b".

Figures 6, 7, 8:
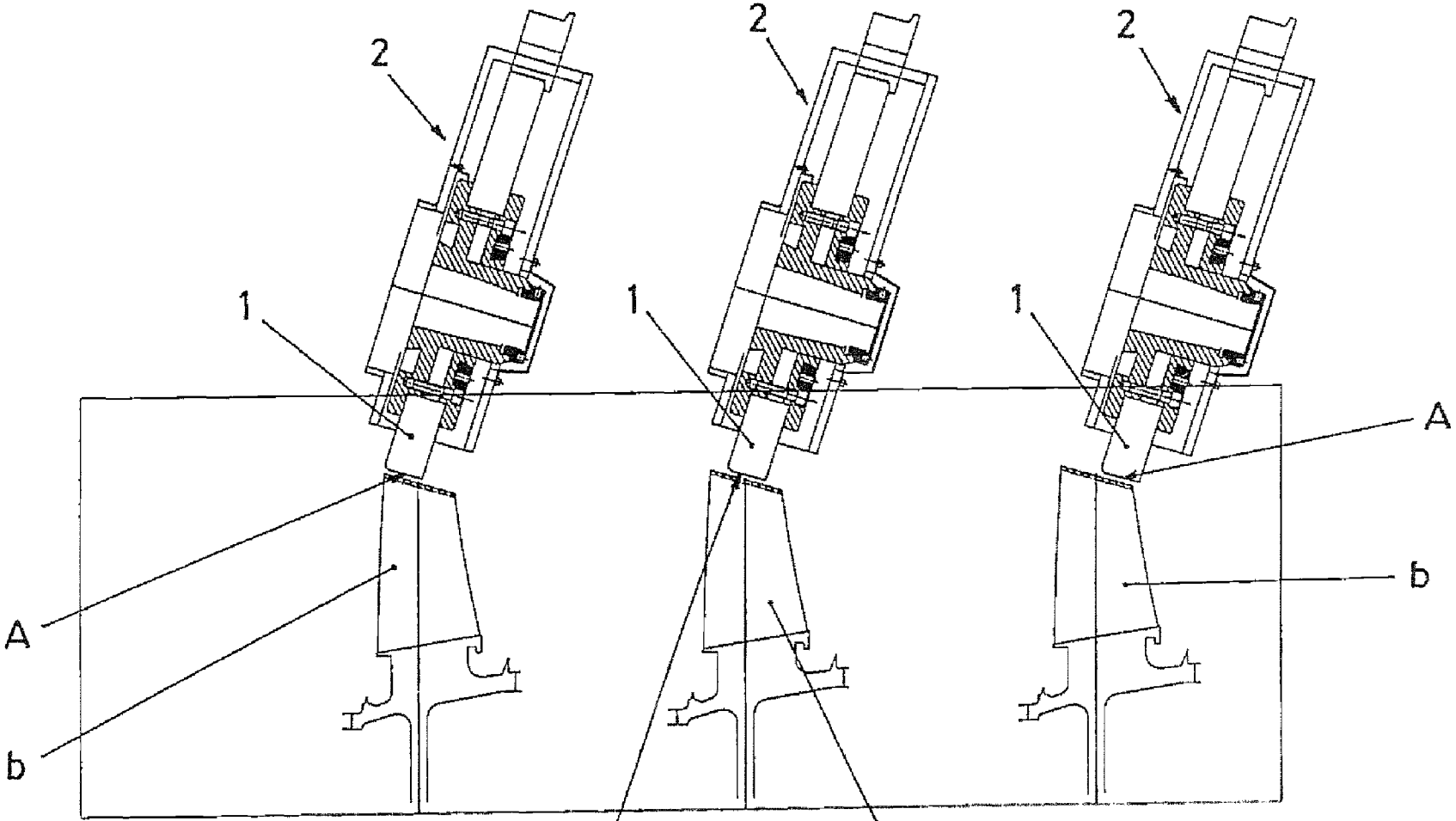
FIGS. 6 to 8 show schematic elevation views of the deburring of the tip of a blade "b" in a multiple "plunging" straight grinding cycle.
Figure 9:
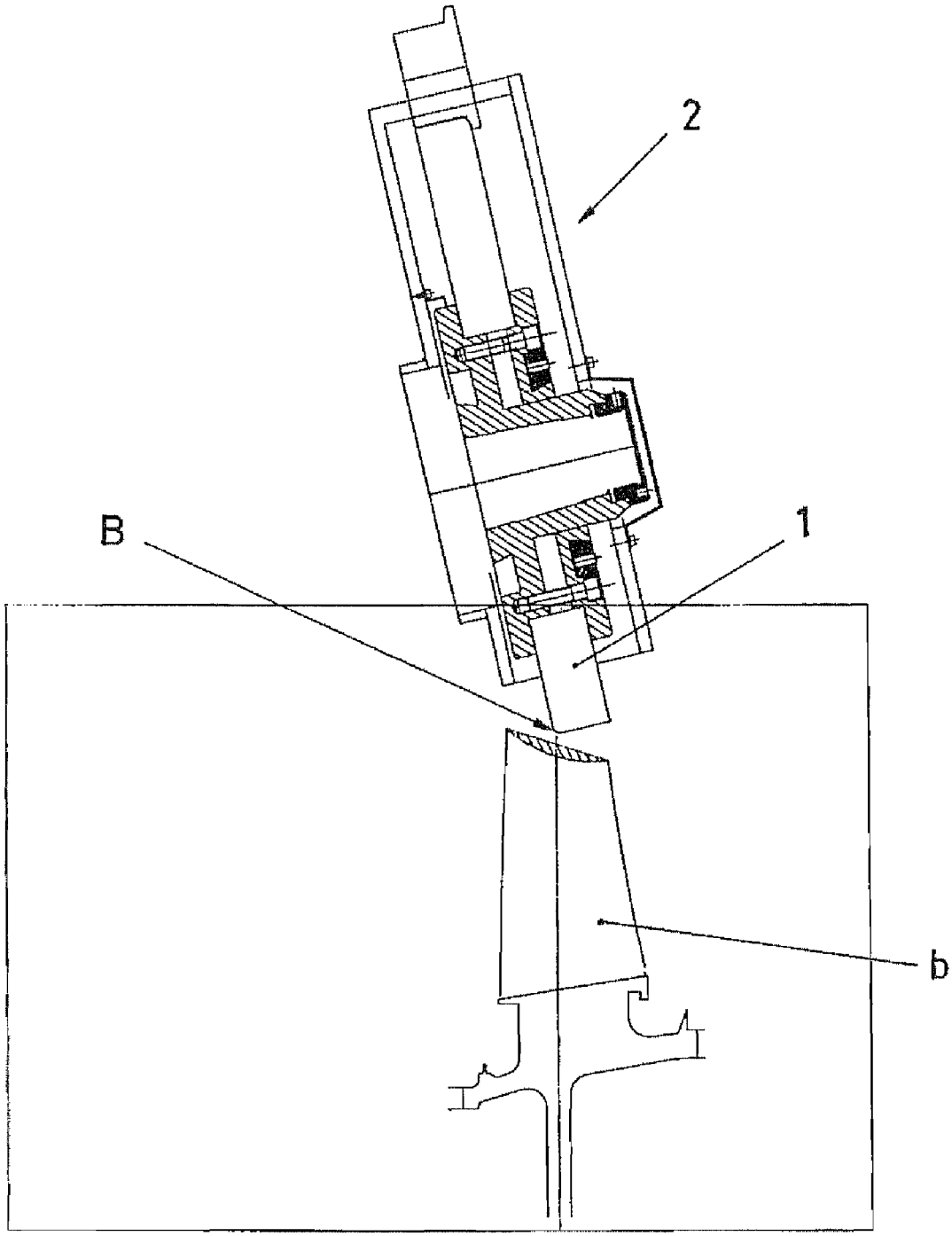
FIG. 9 shows a view similar to the previous ones but now during the contour grinding by means of the arc-convex area 1.2 of the wheel 1.

In the grinding of a blade "b" with a measurement equal to or greater than 73 mm, as is the case of FIGS. 6 to 8, the use of a wheel 1 which is narrower than the tips of the blades "b", the interpolation of the axes which the machine 2 has, as well as the use of the two areas 1.1 and 1.2 which the wheel 1 has according to the features of each tip of blade "b", allows carrying out a multi "plunging" grinding, which considerably reduces the working times.

Indeed, in the deburring phase, the wheel 1 is placed with the necessary angle according to the profile of the tip of the blade "b" by means of swiveling according to the movement "B", and the debarring is carried out by means of multiple movements in axis "X" for moving the wheel 1 closer to the rotor "r", in what is referred to as a multi "plunging".

The deburring process is thus carried out much faster than if it were carried out with a narrow wheel with an arc-convex profile carrying out said deburring by the interpolation of the axes.

The final step of the grinding is carried out by means of the interpolation of axes "Z", "X" and the movement in "B", which the machine has, carrying out a contour grinding of the tips of the blades "b" by means of interpolation (straight, concave, convex) of the penetrating axis, bead 3, wheel 1, and the longitudinal axis, table 4.

If this method herein proposed is compared with the traditional method which used wide wheels, it is also found that this new method for contour grinding wide blades at high speed significantly reduces the total duration of the cycle necessary to machine large compressor rotors, compared with a contouring deburring and finishing process for the stages. If this new method is not applied, it is necessary to charge the wheel (a change from a wider to a narrower wheel) to complete the grinding of the narrowest stages of a compressor rotor, abruptly increasing the cycle and start-up times.

Figure 10:
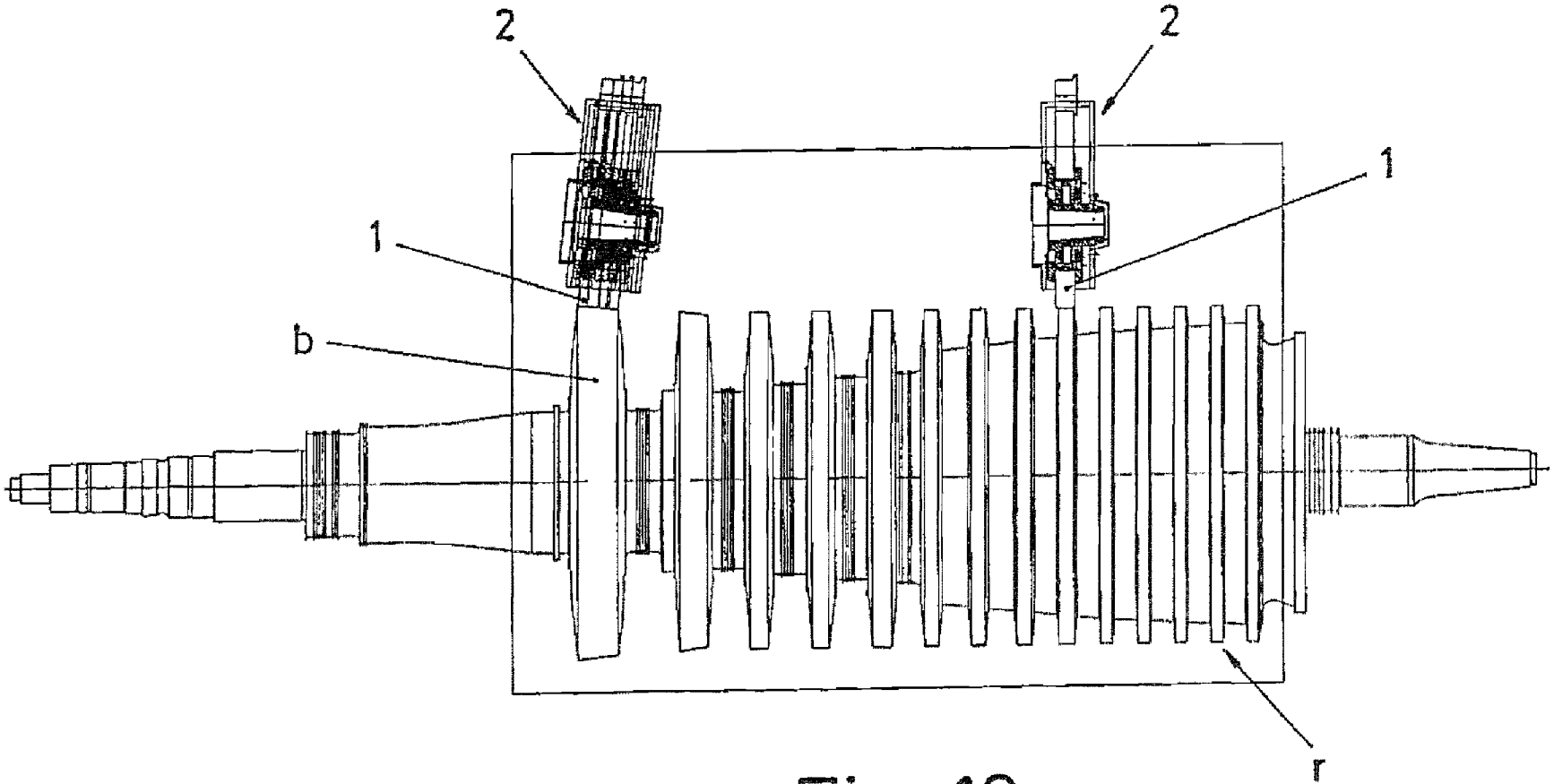
FIG. 10 schematically shows how in the method object of the invention with a narrow wheel 1, the grinding of all the stages of the rotor "r" can be covered without any interference.

FIG. 10 shows a rotor "r" with multiple stages, it is specifically formed by fourteen stages, in which it can be seen how in some cases, the blades "b" of these stages have widths with a measurement that is equal or greater than 73 mm. This is the case of the first five stages of the left-hand part of this FIG. 4. The wheel 1 has a width of less than a 73 mm. As can be seen in FIG. 3, the interferences "i" occurring in the solution shown in FIG. 1 do not occur in the grinding of the narrow blades; such that it is not necessary to change the wheel 1 to complete the grinding of the narrowest stages of a compressor rotor, considerably reducing the working times because a wheel 1 that is narrower than the wide blades "b" can cover the grinding of all the stages of the rotor without any interference "i".

FIG. 4 shows, in relation to the first stage, how the straight deburring grinding is carried out with the straight part 1.1 of the wheel 1 and by means of a multiple "plunging" grinding cycle.

Furthermore and according to the method object of the present invention, both if blades "b" the tip of which has width of less than 73 mm are ground, and if wide blades the tip of which is equal to or greater than 73 mm are ground, the measurement can be applied in the process because the contouring is obtained by means of the interpolation of axes that do not interfere with the axes necessary to operate the measuring device. This will lead to an increase of the precision and to a reduction of the cycle duration because the measurement and the grinding can take place simultaneously.

The invention claimed is:

1. A method for contour grinding a blade at high speeds, which has a width equal to or greater than seventy-five millimeters, the method comprising the following steps:

grinding the blade using a wheel which is narrower than a width of the blade, a grinding contour of the wheel having a profile defined by a transversely straight area which only at one end has an arched area; and deburring the blade using the straight part of the wheel in a single, multi-plunging grinding cycle, wherein the grinding contour has a width of less than seventy-five millimeters, and the grinding of the arched area is carried out by an interpolation of axes.

2. The method for contour grinding a blade at high speeds according to claim 1, wherein the contour grinding with the arched area of the wheel is carried out by means of straight, concave and/or convex interpolation of a penetrating and swiveling movement of a wheel head of the wheel, and a longitudinal movement of a table that bears the blade to be grinded.

3. The method for contour grinding a blade at high speeds according to claim 2, wherein to grind a rotor with several stages in which some of the stages are formed by wide blades, said grinding is carried out with the same wheel, without interferences upon grinding adjacent blade stages.

4. The method for contour grinding a blade at high speeds according to claim 1, wherein to grind a rotor with several stages in which some of the stages are formed by wide blades, said grinding is carried out with the same wheel, without interferences upon grinding adjacent blade stages.

* * * * *